US005326588A

United States Patent [19]

Ji

[11] Patent Number: 5,326,588

[45] Date of Patent: Jul. 5, 1994

[54] CATHODE RAY TUBE

[75] Inventor: Hang-ku Ji, Kyunggi-do, Rep. of Korea

[73] Assignee: Samsung Electronic Devices Co., Ltd., Kyuggi-do, Rep. of Korea

[21] Appl. No.: 725,073

[22] Filed: Jul. 3, 1991

[30] Foreign Application Priority Data

Jul. 4, 1990 [KR] Rep. of Korea ..... 90-10099

[51] Int. Cl.[5] ..... B05D 5/06

[52] U.S. Cl. ..... 427/68; 427/389.7; 427/404; 427/407.2

[58] Field of Search ..... 427/68, 389.7, 407.2, 427/404

[56] References Cited

U.S. PATENT DOCUMENTS 3,940,508 2/1976 Wilcox ..... 427/68
4,293,586 10/1981 Unnai ..... 427/68
4,339,475 7/1982 Hinosugi et al. ..... 427/68
4,990,366 2/1991 Pozzolo et al. ..... 427/68

*Primary Examiner*—Janyce Bell
*Attorney, Agent, or Firm*—Cushman, Darby & Cushman

[57] ABSTRACT

A method for manufacturing a screen of a color cathode ray tube, comprising the steps of: (a) coating an adhesion strengthening layer over the inner surfaces of a panel and a panel skirt; (b) coating black matrix stripes and fluorescent stripes on the adhesion strengthening layer in the panel; (c) coating a pyrolysis mitigating layer on said adhesion strengthening layer within the panel skirt; (d) coating an organic film on the black matrix and fluorescent stripes; and (e) coating a thin metal film on the resultant structure. The pyrolysis of the poly vinyl alcohol is delayed during baking by the acryl emulsion contained in the pyrolysis mitigating layer. This process prevents swelling up and peeling off of the thin metal film during the baking step, and reduces inferior products that result from the peeling off of pieces of the metal layer.

3 Claims, 1 Drawing Sheet

CATHODE RAY TUBE

FIELD OF THE INVENTION

The present invention relates to a method for manufacturing a screen of a color cathode ray tube and, more particularly, relates to a method for manufacturing a screen of a color cathode ray tube in which the swelling up of the metal film of a screen can be prevented.

BACKGROUND OF INVENTION

A screen formed on the inner surface of the panel of a color cathode ray tube has a multi-layered, thin film structure as shown in FIG. 1. This screen comprises a plurality of fluorescent stripes or dots 1 or red, green and blue colors which are alternately arranged on the inside of panel P with black matrix stripes 2. The black matrix stripes isolate the respective neighboring fluorescent stripes of different colors and absorb the light entering from outside the panel. A thin metal film 3, is formed on the outermost surface of the structure.

Both the fluorescent stripes 1 and black matrix stripes 2 are formed substantially on the same plane. The thin metal film 3 covers the fluorescent stripes 1 and black matrix stripes 2. The reference letter "S" in the drawing denotes the skirt of panel.

This final multi-layered structure is only a portion of all of the layers which are formed during manufacture of the screen. The remainder of the materials used during manufacture of the screen are removed by burning and decomposition through the so-called etching process and baking process.

Description of the above process is now given in greater detail. Initially, the whole inner surface of the panel is coated with a precoating agent. This forms an adhesion strengthening layer as the first layer on the panel. Next, a sensitive resin film coating is applied to the adhesion strengthening layer in order to form a black matrix. This sensitive resin film is applied by way of photo lithography and the film is then removed in a developing process, which is the final step of the black matrix stripe manufacturing process.

After the black matrix stripes are formed, different colored fluorescent stripes are formed alternately in the intervals between the respective neighboring black matrix stripes. Following this, the whole surface of the above is covered with filming agent and dried out. This produces a layer of organic film on the black matrix stripes and fluorescent stripes. Finally, a metal film, for example, an aluminum film, is applied to cover the multi-layered structure. The layer of organic film applied to the stripes serves to prevent the metal film from intruding into the fluorescent stripes and to improve upon the flatness of the metal film.

Once formation of the layered structure is complete, the layer of organic film and the lowermost adhesion strengthening layer are removed using a baking process.

In the above screen manufacturing process, it is during the baking process that there is concern that the metal film will become swollen and deformed. This concern is particularly strong for the portion of the metal film which is formed on the panel skirt, the peripheral portion of a screen. The metal film swelling occurs because the precoating agent is rapidly vaporized by high temperature heat, and the gas generated therefrom causes the metal film to become swollen up.

The swollen metal film may peel off into pieces. These pieces of metal film consequently remain as foreign objects inside the cathode ray tube, and may result in arcing between electron guns and the phenomenon of the blocking of holes of the shadow mask.

SUMMARY OF THE INVENTION

The object of the present invention is to provide a method of manufacturing a screen of a color cathode ray tube which can resolve the above stated problems, i.e. swelling of the metal film which reduces cathode ray tube performance.

The present invention is a process for the manufacturing a screen of a cathode ray tube, comprising the steps of:

(a) coating an adhesion strengthening layer on the inner surface of a panel and a panel skirt wherein the adhesion strengthening layer comprises a precoating material whose main component is polyvinyl alcohol;

(b) coating black matrix stripes and fluorescent matrix stripes on said adhesion strengthening layer within the panel;

(c) coating a pyrolysis mitigating layer on said adhesion strengthening layer within the panel skirt;

(d) coating an organic film layer on the black matrix stripes and fluorescent stripes;

(e) coating a thin metal film on the pyrolysis mitigating layer and organic film;

(f) baking the resulting structure, thereby vaporizing and removing said adhesion strengthening layer, organic film layer, and pyrolysis mitigating layer.

The pyrolysis mitigating layer used in the present invention is made of a mixture of an acryl emulsion, 2% poly vinyl alcohol, ammonium oxalate and pure water in the ratio of approximately 1:1:1:21 by weight. The poly vinyl alcohol is a binder and the acryl emulsion serves to reduce the pyrolysis speed of the poly vinyl alcohol. The ammonium oxalate is an optional component of the film and serves to make minute pores in the metal film of the screen.

DESCRIPTION OF THE PREFERRED EMBODIMENTS

The present invention will now be explained in detail through an embodiment thereof with reference to the drawings.

Figure 2A:
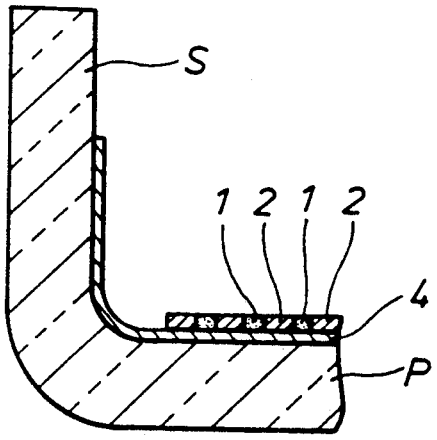
FIGS. 2A, 2B, 2C and 2D sequentially illustrate the screen manufacturing process according to the present invention.

(A) As illustrated in FIG. 2A, using a conventional method, the adhesion strengthening layer 4 is coated over the inner surfaces of the panel and panel skirt of the cathod ray tube. The main ingredient of the adhesive strengthening layer is poly vinyl alcohol. Other constituents of the adhesive strengthening layer include photosensitizer, e.g. ammonium dichromate, and pure water. The black matrix stripes 1, and the fluorescent stripes 2, composed of fluorescent material of various colors, are then coated on the adhesion strengthening layer 4 within the inner surface of panel P. Suitable compounds for use as black matrix stripes include graphite. Suitable compounds for use as the fluorescent stripes include phosphor, polyvinyl alcohol, photosensitizer, pure water, ethylene glycol, surface active agent, e.g., sorbitan monolaurate polymer, polymer of propylene oxide and ethylene oxide, sodium dinaphthyl metasulfamate.

Figure 2B:
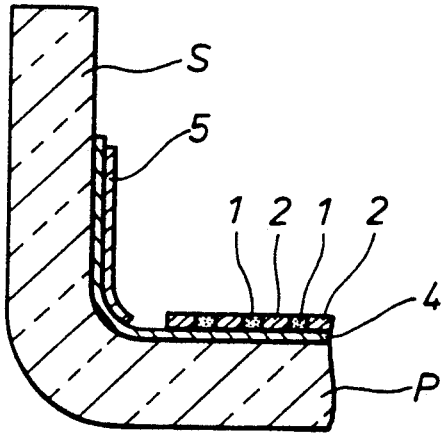

(B) Next, as illustrated in FIG. 2B, a pyrolysis mitigating layer 5 is coated onto the adhesion strengthening layer 4 within the panel skirt portion S. The pyrolysis mitigating layer comprises a mixture of acryl emulsion, 2% poly vinyl alcohol, ammonium oxalate and pure water in the ratio of approximately 1:1:1:21 by weight. Acryl emulsion is a thermoplastic acrylic emulsion polymer.

A preferred acryl emulsion is a thermoplastic acrylic emulsion polymer which is sold by Rohm & Haas under the trademark "Rhoplex B-74". This polymer is a thermoplastic acrylic emulsion polymer which forms smooth, clear, and continuous films at a temperature of 41° C. and above. In addition, it can be readily redispersed in mild alkali solution. The emulsion has the following typical properties:

| | |
|---|---|
| Appearance | White Milky liquid |
| Solids | 38% |
| Viscosity at 25° C. Brookfield LVF, #1 spindle at 60 rpm | 55 cps, maximum |
| Weight per gallon | 8.7 lbs |
| pH | 2.8 |
| Minimum Film forming temp. | 4° C. |
| Acid Number | 16 to 19 |
| Colloidal Charge | Anionic |

The poly vinyl alcohol serves as a binder. The acryl emulsion reduces the pyrolysis speed of the poly vinyl alcohol. The ammonium oxalate, which is an optional element, forms numerous minute pores in the peripheral edge of the thin metal film 3, due to the pin-type crystal structure of the ammonium oxalate.

Figure 2C:
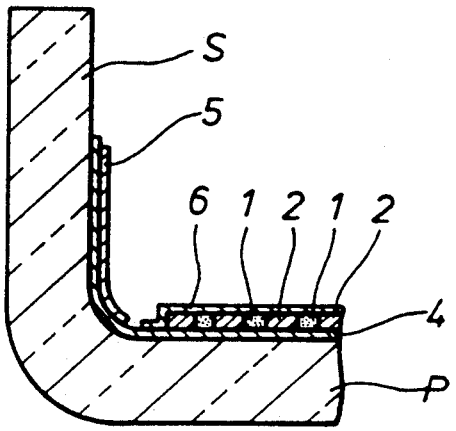

(C) In addition, as illustrated in FIG. 2C, a layer of film 6, which is made of an organic material, is coated by a conventional method, over the inner portion of the panel on which the black matrix stripes and fluorescent stripes have been formed. Suitable organic materials for use as the organic film include polyvinyl alcohol, acryl emulsion, ammonium oxalate, glycerin, hydrogen peroxide, ammonia water. The film of organic materials is not coated on the skirt of the panel on which the pyrolysis mitigating layer 5 has been formed.

Figure 2D:
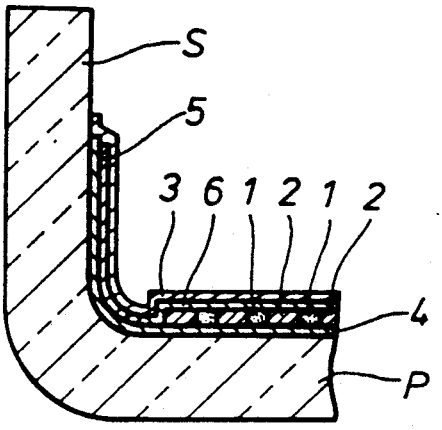

(D) As illustrated in FIG. 2D, a thin metal film layer 3 made of aluminum is coated on all surfaces of the pyrolysis mitigating layer 5 and the organic film layer 6.

Figure 1:
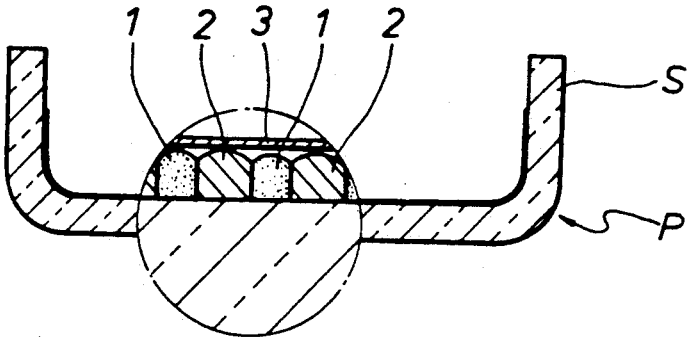
FIG. 1 is a sectional view of a panel with enlarged sectional view of a screen of a cathode ray tub.

(E) After the successive steps of forming these layers of a screen are completed, a completed screen, as shown in FIG. 1, is obtained by baking the multi-layered structure.

In the screen obtained through the above mentioned manufacturing procedure, the adhesion strengthening layer 4, the pyrolysis mitigating layer 5 and the organic film layer 6 were vaporized into organic gases and removed during the baking step. Examination of an enlarged sectional view of the screen which has undergone the baking process, confirms that the aforesaid organic layers have been completely removed. No swelling up of the metal film, caused by the organic gases formed during the baking step, was observed in the present invention.

The reduction in swelling occurs because, in the baking step, the acryl emulsion contained in the pyrolysis mitigating layer causes a delay of pyrolysis of the poly vinyl alcohol when the layered structure undergoes baking. In addition, when an ammonium oxalate with a pin type crystal, which is optionally contained in the pyrolysis mitigating layer, is present, it forms minute pores on the thin metal film layer. These pores allow the organic gas generated during pyrolysis can easily be exhausted.

As stated above, the chemical agent for pyrolysis mitigating used in the present invention remarkably decreases the number of inferior products produced by effectively preventing the swelling up and peeling off of the thin metal film formed on the panel skirt.

What is claimed is:

1. A method for manufacturing a screen of a color cathode ray tube comprising a panel and a panel skirt, the method comprising the steps of:

(a) coating an adhesion strengthening layer comprising poly vinyl alcohol and photosensitizer over an inner surface of the panel and an inner surface of the panel skirt;

(b) coating black matrix stripes and fluorescent stripes on said adhesion strengthening layer within boundaries of the panel;

(c) coating a pyrolysis mitigating layer comprising mixture of 38% acryl emulsion, 2% poly vinyl alcohol and water in the ratio of approximately 1:1:21 by weight on said adhesion strengthening layer within boundaries of the panel skirt;

(d) coating an organic film layer comprising organic film forming resin over the black matrix stripes and fluorescent stripes within boundaries of the panel;

(e) coating a thin metal film on the organic film layer and the pyrolysis mitigating layer; and (f) baking the resulting layered structure, thereby removing said adhesion strengthening layer, organic film layer and pyrolysis mitigating layer.

2. A method for manufacturing a screen of a color cathode ray tube according to claim 1, wherein said pyrolysis mitigating layer further comprises ammonium oxalate in about the same weight ratio of the acryl emulsion.

3. A method of manufacturing a screen of a color cathode ray tube according to claim 1, wherein the organic film layer comprises poly vinyl alcohol, and acryl emulsion.

* * * * *